US008550273B2

(12) United States Patent
Levin et al.

(10) Patent No.: US 8,550,273 B2
(45) Date of Patent: Oct. 8, 2013

(54) CRYOGENIC VIALS

(75) Inventors: Benjamin Levin, Vineland, NJ (US); Brian M. Gatton, Jr., Franklinville, NJ (US); Peter M. Zielinski, Millville, NJ (US)

(73) Assignee: Wheaton Industries, Inc., Millville, NJ (US)

( * ) Notice: Subject to any disclaimer, the term of this patent is extended or adjusted under 35 U.S.C. 154(b) by 217 days.

(21) Appl. No.: 12/872,426

(22) Filed: Aug. 31, 2010

(65) Prior Publication Data

US 2012/0048827 A1 Mar. 1, 2012

(51) Int. Cl.

| | |
|---|---|
| ***B65D 41/00*** | (2006.01) |
| ***B65D 88/00*** | (2006.01) |
| ***B65D 55/16*** | (2006.01) |
| ***B01L 3/14*** | (2006.01) |

(52) U.S. Cl.
USPC ..... 220/1.5; 220/375; 422/550; 215/321

(58) Field of Classification Search
USPC ..... 206/828, 459.1, 495.5, 459.5, 534; 220/901, 375, 288, 560.04, 259, 256, 220/203.13, 1.5, 560.09, 649, 647, 628, 220/631, 634, 636, 304, 86.2, 378, 293, 220/789; 215/329, 235, 316, 45, 296, 43, 215/343–344, 364, 355, 230, 321, 41, 294, 215/358; 40/310; 216/495.5
See application file for complete search history.

(56) References Cited

U.S. PATENT DOCUMENTS

| | | | | |
|---|---|---|---|---|
| 1,879,820 | A | | 9/1932 | Perry |
| 3,151,740 | A | * | 10/1964 | Simon ..... 206/37 |
| 3,255,916 | A | * | 6/1966 | Rice ..... 220/304 |
| D205,893 | S | | 10/1966 | Weichselhaum |
| 3,330,281 | A | | 7/1967 | Visser et al. |
| 3,419,179 | A | * | 12/1968 | Deuschle et al. ..... 220/375 |
| 3,481,712 | A | | 12/1969 | Bernstein et al. |
| 3,902,619 | A | * | 9/1975 | Gouget ..... 215/50 |
| 3,923,179 | A | * | 12/1975 | Choksi et al. ..... 215/203 |
| 4,105,415 | A | | 8/1978 | Lovett |
| 4,117,946 | A | * | 10/1978 | Kessler ..... 215/321 |
| 4,335,827 | A | * | 6/1982 | Knize et al. ..... 220/284 |
| 4,364,903 | A | | 12/1982 | Bittings |
| D292,824 | S | | 11/1987 | Babashak |
| 4,713,974 | A | | 12/1987 | Stone |
| 4,785,563 | A | * | 11/1988 | Friedman ..... 40/301 |
| D302,722 | S | | 8/1989 | Baxter |

(Continued)

FOREIGN PATENT DOCUMENTS

| | | | |
|---|---|---|---|
| DE | 10336523 | A1 | 2/2005 |
| DE | 202006001995 | U1 | 6/2006 |
| WO | WO2007/001789 | A2 | 1/2007 |

*Primary Examiner* — J. Gregory Pickett
*Assistant Examiner* — James M Van Buskirk
(74) *Attorney, Agent, or Firm* — RatnerPrestia

(57) ABSTRACT

A vial including an end wall with a given perimeter, a side wall depending from the end wall about the given perimeter, and a plug wall depending from the end wall such that an outer surface of the plug wall is radially inward and spaced from the side wall. The plug wall has an attached end portion and a free end portion. The outer surface along the attached end portion of the plug wall is angled relative to the end wall by a first angle and the outer surface along the free end portion is angled relative to the outer surface along the attached end portion and extends at a second angle relative to the end wall with the second angle being larger than the first angle.

3 Claims, 6 Drawing Sheets

(56) References Cited

U.S. PATENT DOCUMENTS

| | | | | |
|---|---|---|---|---|
| D304,997 | S | 12/1989 | Baxter | |
| D307,052 | S | 4/1990 | Baxter | |
| D310,264 | S | 8/1990 | Leoncavallo et al. | |
| D318,727 | S | 7/1991 | Spike | |
| 5,038,958 | A | 8/1991 | Dreier | |
| D341,205 | S | 11/1993 | Greenley | |
| D342,141 | S | 12/1993 | Baxter | |
| 5,344,036 | A | 9/1994 | Stanescu et al. | |
| 5,382,409 | A | 1/1995 | Baxter | |
| D356,643 | S | 3/1995 | Burns | |
| 5,470,537 | A | 11/1995 | Siegel | |
| 5,536,476 | A | 7/1996 | Baxter | |
| 5,665,558 | A | 9/1997 | Frame et al. | |
| D388,176 | S | 12/1997 | Lodge | |
| 5,750,075 | A | 5/1998 | Spike | |
| 5,944,057 | A * | 8/1999 | Pierce | 138/89 |
| 6,066,299 | A | 5/2000 | Lodge | |
| D427,691 | S | 7/2000 | Asselta | |
| D438,982 | S | 3/2001 | Lodge et al. | |
| 6,237,843 | B1 * | 5/2001 | Falat et al. | 229/125.35 |
| D453,837 | S | 2/2002 | Lodge | |
| 6,368,741 | B1 * | 4/2002 | Hackel et al. | 429/53 |
| D469,185 | S | 1/2003 | Lodge | |
| 6,695,161 | B2 * | 2/2004 | Kano et al. | 215/341 |
| 6,702,134 | B2 * | 3/2004 | Scalese et al. | 215/344 |
| 7,014,055 | B2 * | 3/2006 | Kano et al. | 215/344 |
| 2003/0133844 | A1 | 7/2003 | Conway | |
| 2005/0098562 | A1 * | 5/2005 | Gerdes | 220/304 |
| 2007/0187353 | A1 | 8/2007 | Fox et al. | |
| 2008/0230507 | A1 * | 9/2008 | Peacop et al. | 215/329 |
| 2010/0072163 | A1 * | 3/2010 | Krause | 215/230 |

* cited by examiner

CRYOGENIC VIALS

The present invention relates to cryogenic vials. More particularly, the present invention relates to a cryogenic vial having an improved cap.

BACKGROUND OF THE INVENTION

The growing need to collect and store a wide range of biological samples for research has led to the creation of biorepositories. To ensure the viability of biospecimens being stored in biorepositories over long periods, the samples are placed in sterile plastic or glass vials and then immersed into the vapor phase of Liquid Nitrogen (LN2). It is important that the content of the vials maintain sample integrity during storage at low temperatures as well as during the retrieval and thawing process. Vial leakage is the main source of sample contamination. If the biospecimen is contaminated, it is rendered useless for further scientific research. Cryogenic vial leakage is caused by the failure of the seal made by the cap and the vial.

Additionally, with the increase in the number of stored biological samples, it becomes increasingly important to effectively identify, store and track the vials.

SUMMARY OF THE INVENTION

In at least one embodiment, the present invention provides a vial including an end wall with a given perimeter, a side wall depending from the end wall about the given perimeter, and a plug wall depending from the end wall such that an outer surface of the plug wall is radially inward and spaced from the side wall. The plug wall has an attached end portion and a free end portion. The outer surface along the attached end portion of the plug wall is angled relative to the end wall by a first angle and the outer surface along the free end portion is angled relative to the outer surface along the attached end portion and extends at a second angle relative to the end wall with the second angle being larger than the first angle.

In at least one embodiment, the present invention provides a cryogenic vial and cap assembly. The vial has a tubular body with a closed end and an open end with at least one crush ring extending radially from an outside surface of the tubular body proximate to the open end. The cap includes an end wall with a given perimeter, a side wall depending from the end wall about the given perimeter and a plug wall depending from the end wall such that an outer surface of the plug wall is radially inward and spaced from the side wall. The cap is configured to receive the open end of the vial tubular body with the plug wall biasing the at least one crush ring against the side wall.

In at least one embodiment, a cryogenic vial and cap assembly of the present invention includes a vial having a tubular body with a closed end and an open end with vial threads defined about the tubular body spaced from the open end such that a non-threaded portion of the tubular body is defined between the vial threads and the open end. The cap has an end wall and a side wall depending therefrom with cap threads defined about the sidewall spaced from the end wall such that a non-threaded portion of the side wall is defined between the cap threads and the end wall. A sealing member sealingly engages the non-threaded portion of the tubular body and the non-threaded portion of the side wall when the cap threads threadably engage the vial threads.

In at least one embodiment, the present invention provides a vial assembly including a tubular body with an open end and a tapered closed end. A skirt depends from the tubular body about the tapered closed end with an open end of the skirt extending beyond the tapered closed end. An identification member having an identification indicia on a surface thereof is configured to be received and retained within the skirt open end with the identification indicia aligned with the skirt open end.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Referring to FIGS. 1-4 and 6-8, a cryogenic vial and cap assembly 10 in accordance with an exemplary embodiment of the present invention. The assembly 10 generally includes a vial 12 and a cap 40. The vial 12 and cap 40 are preferably manufactured from the same material, for example, low binding, cryogenic grade, virgin polypropylene, such that they respond to temperature changes in a similar manner. Other materials may also be utilized.

Figure 1:
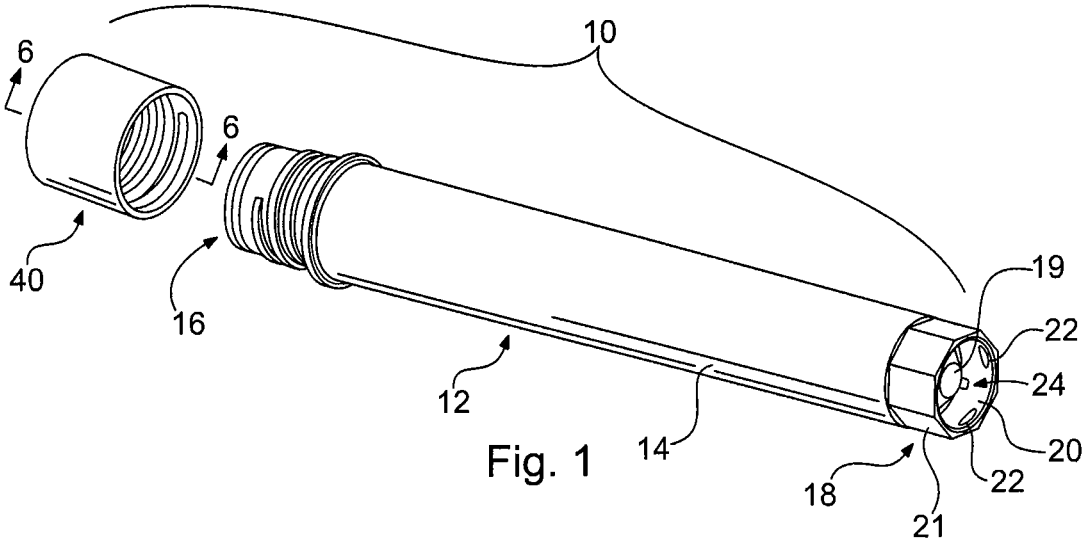
FIG. 1 is a perspective view of a vial and cap assembly in accordance with an embodiment of the present invention.
Figure 2:
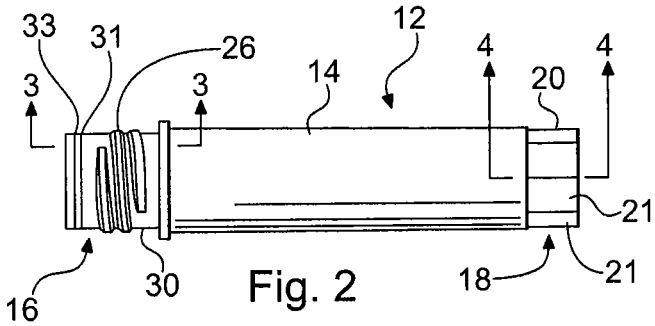
FIG. 2 is a side elevation view of the vial of FIG. 1.
Figure 4:
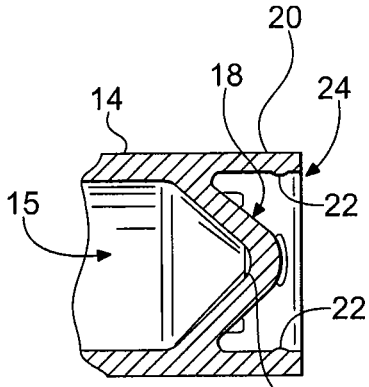
FIG. 4 is a cross-sectional view along the line 4-4 in FIG. 2.
Figure 3:
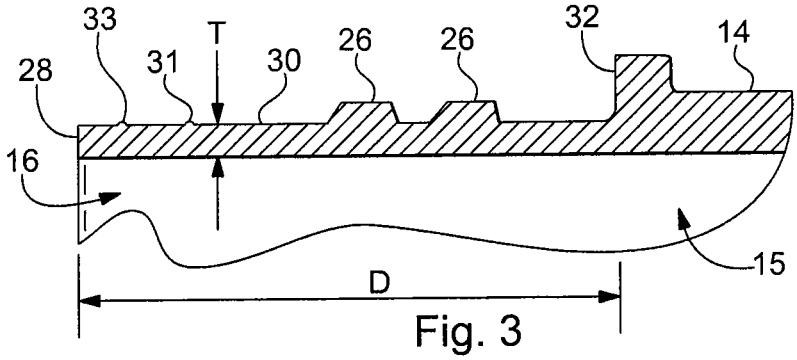
FIG. 3 is a cross-sectional view along the line 3-3 in FIG. 2.

With reference to FIGS. 2-4, the vial 12 has a generally tubular body 14 extending between an open end 16 and a closed end 18 with a cavity 15 defined within the body 14. The closed end 18 of the vial 12 of the present embodiment is tapered to a reduced diameter 19 to facilitate collection of samples within the cavity 15. A skirt 20 depends from the tubular body 14 and extends about the tapered closed end 18. The skirt 20 extends to a skirt open end 24 which is beyond the closed end 18 of the tubular body 14. The skirt 20 provides a base to support the vial 12 in a standing position. The skirt 20 may include a series of flat surfaces 21 which mate with surfaces of a corresponding rack or the like and hold the vial 12 against rotation which may assist in cap securing or removal. A snap projection 22 may extend inwardly from the skirt 20 for attachment of an identification member as described hereinafter. The snap projection 22 may be a continuous ring or spaced projections as shown in FIG. 1.

The open end 16 of the vial 12 includes a series of vial threads 26 along an outside surface of the tubular body 14. The vial threads 26 are positioned between a radial shoulder 32 extending from the outside surface of the tubular body 14 and an end surface 28 at the open end 16. The radial shoulder 32 defines a stop for the cap 40 and is positioned relative to the vial threads 26 to prevent over-torquing of the cap 40. The radial shoulder 32 is spaced from the end surface 28 by a distance D which is preferably associated with a distance within the cap 40 as described below.

The vial threads 26 are spaced from the end surface 28 to define a non-threaded portion 30 of the tubular body 14 between the vial threads 26 and the end surface 28. The non-threaded portion 30 has a thickness T as illustrated in FIG. 3. In the present embodiment, one or more, two in the illustrated embodiment, crush rings 31, 33 extend radially from the non-threaded portion 30 of the tubular body 14. The crush rings 31, 33 define a sealing member configured to sealingly engage between the tubular body 14 and a side wall 44 of the cap 40 when the cap 40 is threadably engaged with the vial 12.

Figure 5:
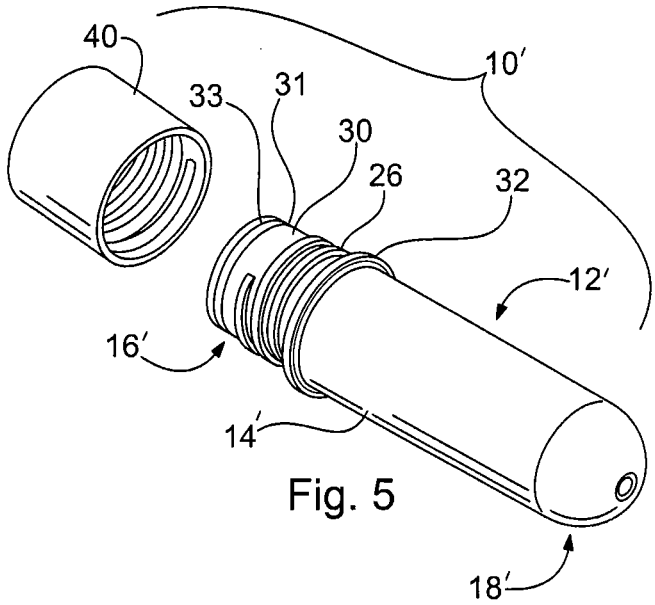
FIG. 5 is a perspective view of a vial and cap assembly in accordance with an alternative embodiment of the present invention.

FIG. 5 illustrates a vial and cap assembly 10' with a vial 12' having a tubular body 14' with a closed end 18' without a skirt. Instead, the closed end 18' has a semi-spherical configuration. The open end 16 of the vial 12' is the same as described above with respect to the vial 12 and functions with regard to the cap 40 as described below with respect to both assemblies 10, 10'.

Figure 6:
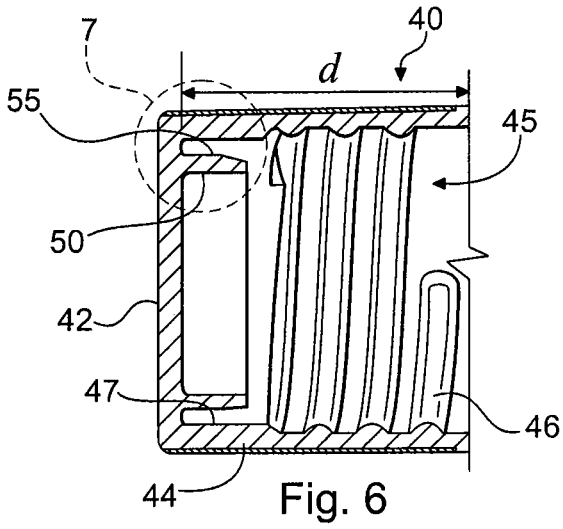
FIG. 6 is a cross-sectional view along the line 6-6 in FIG. 1.
Figure 7:
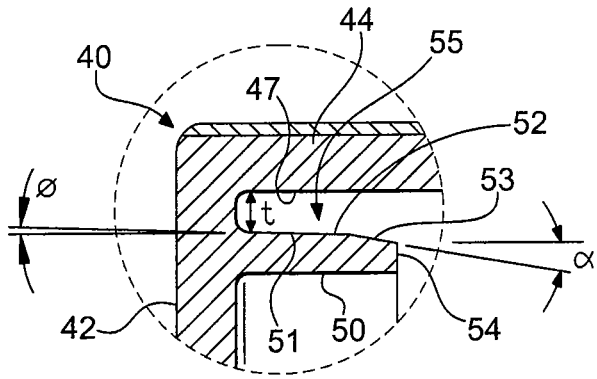
FIG. 7 is an expanded view of a portion of the cap of FIG. 6.
Figure 8:
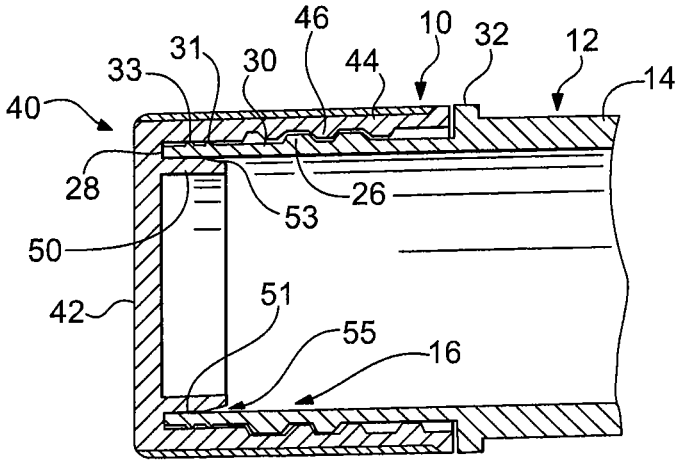
FIG. 8 is a cross-sectional view of the cap and vial of FIG. 1 in an assembled condition.

Referring to FIGS. 6-8, the cap 40 includes an end wall 42 with a side wall 44 depending from the perimeter thereof. The side wall 42 defines a cap open end 45 opposite the end wall 42. A plurality of cap threads 46 are defined about the inside surface of the side wall 44 adjacent to open end 45. The cap threads 46 are spaced from the end wall 42 such that a non-threaded portion 47 is defined along the inside surface of the side wall 44.

A plug wall 50 depends from the end wall 42 to a free end 54. The plug wall 50 is preferably concentric with the side wall 44 and spaced radially inward therefrom to define a receiving space 55. The receiving space 55 adjacent the end wall 42 is spaced a distance d from the open end 45 of the side wall 44. The distance d is approximately equal to the distance D between the shoulder 32 and the end surface 28 such that upon complete threading of the cap 40 onto the vial 12, the open end surface 28 is completely received in the receiving space 55. Adjacent to the end wall 42, the plug wall 50 has a minimum distance t from the side wall 44. The minimum distance t is approximately equal to the thickness T of the non-threaded portion 30 of the vial tubular body 14 such that the end surface 28 sealingly engages between the plug wall 50 and the side wall 44 inner surface as shown in FIG. 8.

To facilitate passage of the open end 16 of the vial tubular body 14 into the receiving space 55, the outer surface 52 of the plug wall 50 is preferably angled relative to the end wall 42.

Figure 9:
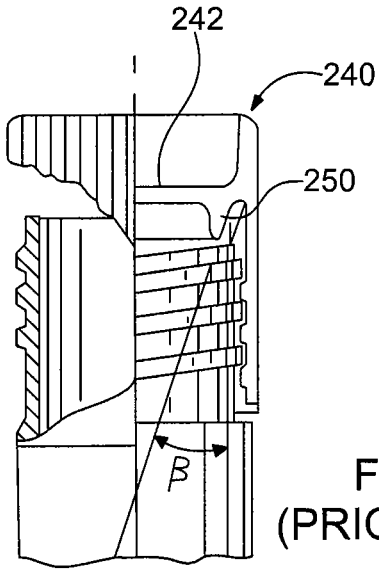
Fig. 9 (PRIOR ART)
FIG. 9 is a partial cross-sectional view of a prior art cap and vial assembly.
Figure 10:
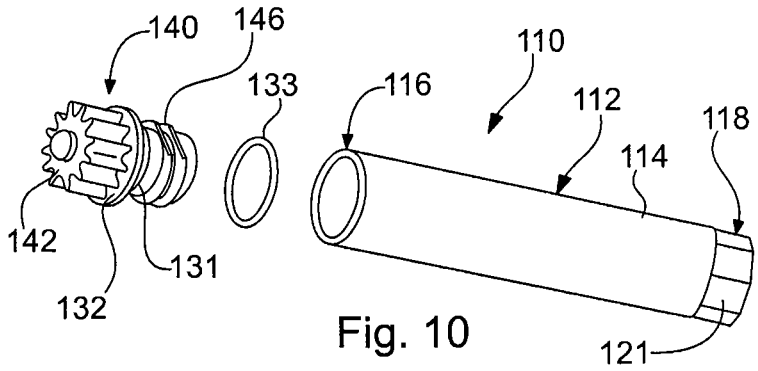
FIG. 10 is a perspective view of a vial and cap assembly in accordance with an alternative embodiment of the present invention.
Figure 11:
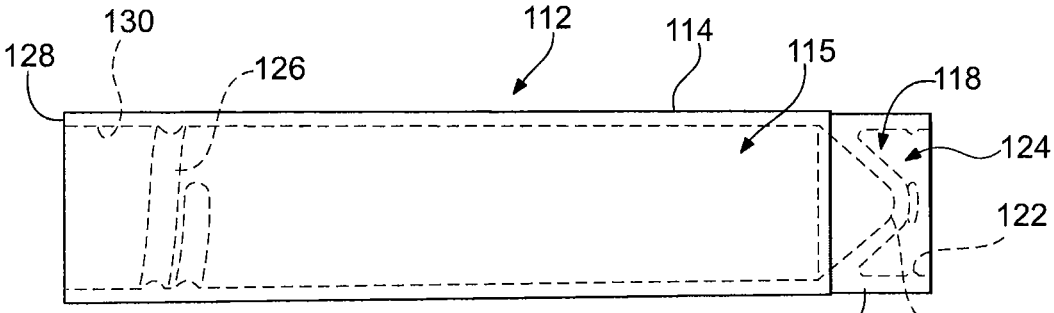
FIG. 11 is a side elevation view of the vial of FIG. 10.

FIG. 9 shows a figure from U.S. Design Patent No. D310,264 which illustrates a cap 240 with a plug wall 250 depending from an end 242. The plug wall 250 is configured such that its outer surface extends at a continuous angle β relative to a plane perpendicular to the end wall 242. The angle β is approximately 10°. While such an angled surface facilitates reception of the vial wall, it provides minimum sealing as the vial wall has only a single point of contact and the remainder of the plug wall 250 angles away from the vial wall.

In the present exemplary embodiment of the invention, the plug wall 50 has an attached end portion 51 and a free end portion 53 which extend at an angle relative to one another. The attached end portion 51 extends at an angle ø relative to a plane perpendicular to the end wall 42. The angle ø is between approximately 1° and 5° such that the attached end portion 51 extends at an angle of between approximately 91° to 95° relative to the end wall 42. The angle ø is preferably about 2°. The free end portion 53 extends at an angle α relative to a plane perpendicular to the end wall 42. The angle α is between approximately 5° and 15° such that the free end portion 53 extends at an angle of between approximately 95° to 105° relative to the end wall 42. The angle α is preferably about 10°.

The angle α provides sufficient clearance to guide the open end 16 into the receiving space 55 while the angle ø provides minimal clearance such that the tolerance such that the end surface 28 of the vial tubular body 14 sealingly engages between the plug wall 50 and the side wall 44 inner surface and the plug wall inner surface 52 biases the crush rings 31, 33 against the non-threaded portion of the tubular body 14 as shown in FIG. 8.

With this configuration, the vial and cap assembly 10, 10' has four points of contact between the vial 12 and the cap 40. The first point of contact is between the non-threaded portion 30 of the vial body 14 with the non-threaded portion 47 of the cap 40, including the crush rings 31, 33 positioned thereal-ong. The second is between the vial threads 26 and the cap threads 46. The third point of contact is the open end surface 28 within the receiving space 55. The final point of contact is between the side wall 42 and the radial shoulder 32.

Referring to FIGS. 10-14, a cryogenic vial and cap assembly 110 in accordance with another exemplary embodiment of the present invention. The assembly 110 generally includes a vial 112 and a cap 140. The vial 112 and cap 140 are preferably manufactured from the same material, for example, low binding, cryogenic grade, virgin polypropylene, such that they respond to temperature changes in a similar manner. Other materials may also be utilized.

The vial 112 has a generally tubular body 114 extending between an open end 116 and a closed end 118 with a cavity 115 defined within the body 114. The closed end 118 of the vial 112 of the present embodiment is tapered to a reduced diameter 119 to facilitate collection of samples within the cavity 115. A skirt 120 depends from the tubular body 114 and extends about the tapered closed end 118. The skirt 120 extends to a skirt open end 124 which is beyond the closed end 118 of the tubular body 114. The skirt 120 provides a base to support the vial 112 in a standing position. The skirt 120 may include a series of flat surfaces 121 which mate with surfaces of a corresponding rack or the like and hold the vial 112 against rotation which may assist in cap securing or removal. A snap projection 122 may extend inwardly from the skirt 120 for attachment of an identification member as described hereinafter.

The open end 116 of the vial 112 includes a series of vial threads 126 along an inside surface of the tubular body 114. The vial threads 126 are spaced from the end surface 128 to define a non-threaded portion 130 of the tubular body 114 between the vial threads 126 and the end surface 128.

Figure 12:
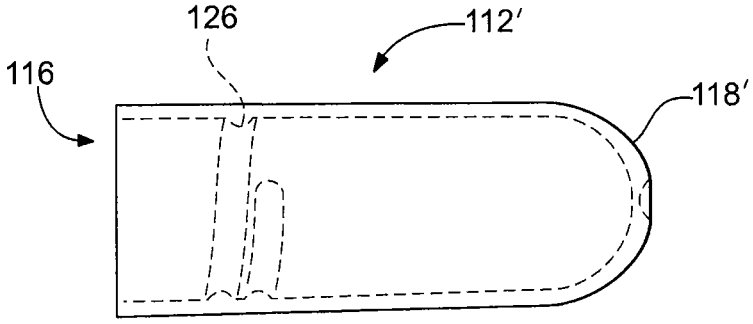
FIG. 12 is a side elevation view of an alternative embodiment of the vial.

FIG. 12 illustrates a vial 112' having a tubular body 114' with a closed end 18' without a skirt. Instead, the closed end 118' has a semi-spherical configuration. The open end 116 of the vial 112' is the same as described above with respect to the vial 112 and functions with regard to the cap 140 as described below with respect to both assemblies 110.

Figure 13:
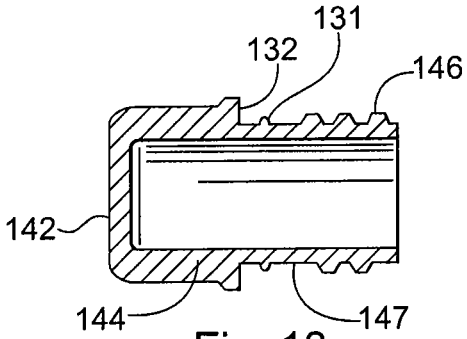
FIG. 13 is a cross-sectional view along the line 13-13 in FIG. 10.

Referring to FIG. 13, the cap 140 includes an end wall 142 with a side wall 144 depending from the perimeter thereof. A radial shoulder 132 is defined about the outer surface of the side wall 144. A plurality of cap threads 146 are defined about the outside surface of the side wall 144 adjacent to a free end of the side wall 144. The cap threads 146 are spaced from the radial shoulder 132 such that a non-threaded portion 147 is defined along the outside surface of the side wall 144. A ring retainer 131 extends from the non-threaded portion 147 and is configured to maintain a sealing ring 133 about the cap side wall 144. The sealing ring 133 is preferably manufactured from an elastomeric material, for example silicone. The sealing ring 133 defines a sealing member configured to sealingly engage between the non-threaded portion 130 of the tubular body 114 and the non-threaded portion 147 of the cap side wall 144.

Figure 14:
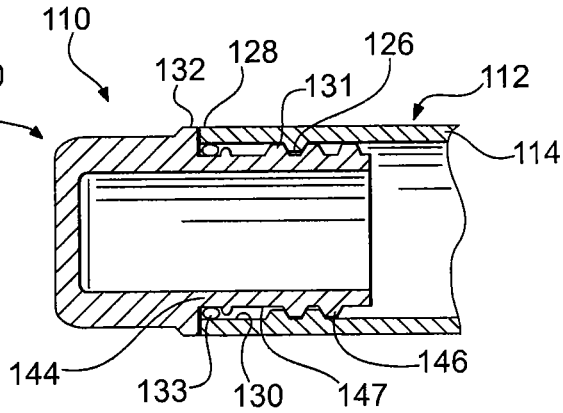
FIG. 14 is a cross-sectional view of the cap and vial of FIG. 10 in an assembled condition.
Figure 15:
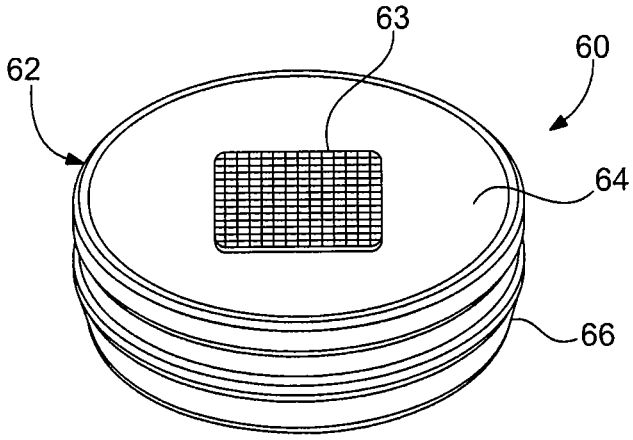
FIG. 15 is a perspective view of an exemplary identification member.
Figure 16:
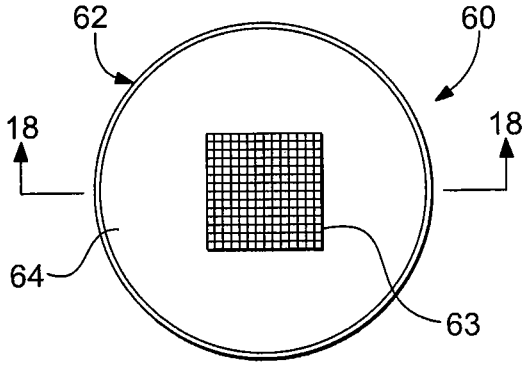
FIG. 16 is a plan view of the identification member of FIG. 15.
Figure 17:
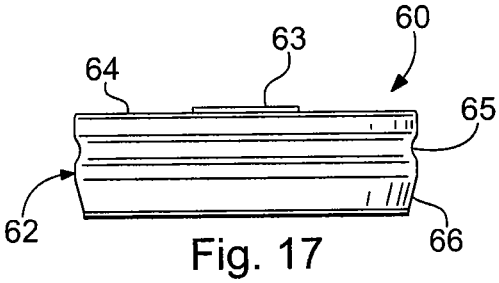
FIG. 17 is a side elevation view of the identification member of FIG. 15.

As shown in FIG. 14, with this configuration, the vial and cap assembly 100 has three points of contact between the vial 112 and the cap 140. The first point of contact is between the sealing ring 133 between the non-threaded portion 130 of the vial body 114 with the non-threaded portion 147 of the cap 140. The second is between the vial threads 126 and the cap threads 146. The third point of contact is the open end surface 128 and the radial shoulder 132.

Figure 18:
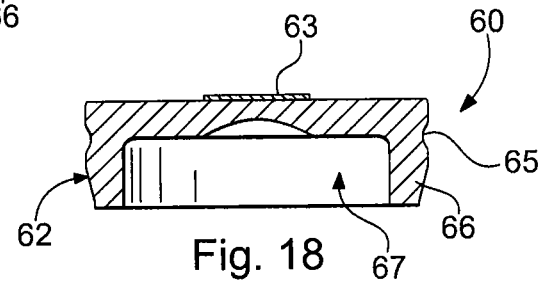
FIG. 18 is a cross-sectional view along the line 18-18 in FIG. 16.

Referring to FIGS. 15-18, an exemplary identification member 60 will be described. The identification member 60 has a body 62 with an end surface 64 with a connecting wall 66 depending therefrom. The body 62 is preferably manufactured from the same material as the vial 12, 112, however other materials may be used. The body 62 is configured to be received in the skirt open end 24, 124 of the vial 12, 12'. As illustrated in FIG. 18, the body 62 has a hollow interior 67 to receive the tapered end 18, 118 of the tubular body 14, 114.

In the exemplary embodiment, the outside surface of the connecting wall 66 has a retaining groove 65 thereabout. The retaining groove 65 is configured to receive the snap projection(s) 22, 122 to maintain the identification member 60 within the skirt 20, 120. The identification member 60 may be otherwise retained within the skirt 20, 120. For example, the identification member 60 may be threadably connected or friction fit within the skirt.

The end surface 64 has an identification indicia 63 thereon. The identification indicia 63 may be for example a 2D data matrix bar code or any other identification means. When the identification member 60 is positioned within the skirt 20, 120, the end surface 64 is positioned such that the identification indicia 63 is aligned with the skirt open end 24, 124 such that the indicia is readable or otherwise available for identify the vial.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A vial assembly comprising:

a tubular body with an open end and a tapered closed end;

a skirt depending from the tubular body about the tapered closed end with an open end of the skirt extending beyond the tapered closed end; and an identification member having an identification indicia on a surface thereof, the identification member configured to be received and retained within the skirt open end with the identification indicia aligned with the skirt open end, the identification member including a hollow interior that is sized to receive and accommodate the tapered closed end of the vial, wherein an interior surface of the open end of the skirt includes a projection that is configured to be attached to a retaining groove on the exterior surface of the identification member.

2. The vial assembly of claim 1 wherein the identification member and vial are manufactured from the same material.

3. The vial assembly of claim 2 wherein the material is polypropylene.

* * * * *